US007934795B2

(12) United States Patent
Ikegame et al.

(10) Patent No.: US 7,934,795 B2
(45) Date of Patent: May 3, 2011

(54) INK JET RECORDING HEAD AND INK JET RECORDING APPARATUS

(75) Inventors: Ken Ikegame, Atsugi (JP); Shigeki Fukui, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 204 days.

(21) Appl. No.: 12/354,404

(22) Filed: Jan. 15, 2009

(65) Prior Publication Data

US 2009/0185000 A1 Jul. 23, 2009

(30) Foreign Application Priority Data

Jan. 23, 2008 (JP) ..... 2008-012885
Jan. 8, 2009 (JP) ..... 2009-002616

(51) Int. Cl.
*B41J 2/14* (2006.01)

(52) U.S. Cl. ..... 347/40; 347/65

(58) Field of Classification Search ..... 347/40, 347/43, 64–66, 33, 70–71
See application file for complete search history.

(56) References Cited

U.S. PATENT DOCUMENTS 5,831,651 A * 11/1998 Usui et al. ..... 347/70
6,431,682 B1 8/2002 Osada et al.
6,447,984 B1 9/2002 Tatsumi et al.
6,527,377 B1 3/2003 Ikegame et al.
6,921,149 B2 * 7/2005 Okuda et al. ..... 347/40
7,350,902 B2 * 4/2008 Dietl et al. ..... 347/43
2003/0048328 A1 3/2003 Inamoto et al.
2009/0015639 A1 1/2009 Fukui et al.
2009/0185001 A1 7/2009 Fukui et al.

FOREIGN PATENT DOCUMENTS

JP 10-157150 A 6/1998
JP 11-138817 5/1999
JP 2003-80717 3/2003

* cited by examiner

*Primary Examiner* — Lamson D Nguyen
(74) *Attorney, Agent, or Firm* — Fitzpatrick, Cella, Harper & Scinto

(57) ABSTRACT

A liquid ejection head includes a substrate including a liquid supply port and a plurality of ejection energy generating elements, disposed along the liquid supply port, and an ejection outlet plate including a plurality of ejection outlets, provided correspondingly to the plurality of ejection energy generating elements, and including a plurality of liquid flow passages, provided correspondingly to the plurality of ejection outlets, for establishing communication between the ejection outlets and the liquid supply port. The ejection outlet plate is provided with a hole portion formed to surround the liquid flow passages. The hole portion includes a plurality of first holes which are arranged in a line and which have opening edges having a shape without an acute angle and further includes a plurality of second holes having opening edges formed in a substantially sawtooth shape, with respect to a direction perpendicular to a surface of the ejection outlet plate.

9 Claims, 8 Drawing Sheets

INK JET RECORDING HEAD AND INK JET RECORDING APPARATUS

FIELD OF THE INVENTION AND RELATED ART

The present invention relates to a liquid ejection head for effecting recording by ejecting liquid such as ink to form ejected liquid droplets. Particularly, the present invention relates to a liquid ejection head including an ejection outlet plate provided with ejection outlets and a plurality of holes formed so as to surround the ejection outlets and liquid flow passages and relates to a recording apparatus including the liquid ejection head.

In a conventional side shooter type ink ejection head, on a substrate provided with heat generating resistors, an ejection outlet plate provided with ejection outlets correspondingly to the heat generating resistors is formed. Between the heat generating resistors and the ejection outlets, ink flow passages are formed. Further, in such an ink ejection head, in order to uniformize a thickness of the ejection outlet plate, a pattern of a dissolvable resin layer as a base is formed and then a flat resin layer is formed on a pattern of a dissolvable resin layer for forming ink flow passages and the pattern as the base. Thereafter, the dissolvable resin layers constituting both of the patterns are removed (Japanese Laid-Open Patent Application (JP-A) Hei 11-138817). As a result, holes are formed so as to surround a periphery of arranged ejection outlet groups, i.e., surround the ink flow passages communicating with the ejection outlets.

A container case to be provided with the substrate, the substrate, and the ejection outlet plate are different in linear expansion, so that a stress is applied to interface portions of the respective members with a change in environmental factor such as heat generation by recording or a storage status. Further, a stress due to an adhesive (sealing agent) for adhering and sealing the container case and the substrate and due to cure shrinkage of the adhesive itself is similarly applied to the respective members. Further, the substrate for the ink ejection head is provided with an ink supply port constituted by a through hole, so that the substrate itself is liable to cause deformation. For that reason, separation can occur between the ejection outlet plate and the substrate by the application of stress to portions, constituting a shape of the ejection outlet plate, such as ends of ink flow passage walls and opening edges of the above-described hole formed at a periphery of the ejection outlets and the ink flow passages.

For that reason, at a hole portion at which the holes are arranged, a constitution for preventing separation between a substrate and an ejection outlet plate is disclosed in JP-A 2003-80717. In the constitution of JP-A 2003-80717, a stress applied to a connecting portion between the substrate and the ejection outlet plate can be relaxed by forming opening edges of the hole portion so that the opening edges are continuously extended in a sawtooth shape.

With the use of recording apparatus, a foreign matter such as dust can be deposited on a surface of the ejection outlet plate. In the case where a recording operation is performed while the foreign matter is deposited on the surface of the ejection outlet plate, a state of surface wettability or the like of the ejection outlet plate is changed. Further, in some cases, the foreign matter clogs the ejection outlets, so that an improper recording operation such as deviation of or ejection failure of ink to be ejected from the ejection outlets can occur. In order to obviate such an improper recording operation, in many cases, the recording apparatus is provided with a refreshing process mechanism as shown in FIG. 8.

At an ink ejection head holding portion of a main assembly of the recording apparatus, as an example of the refreshing process mechanism, a suction refreshing unit 113 including a suction pump (not shown) and a suction cap 113*a* connected to the suction pump is disposed, e.g., as shown in FIG. 8. The refreshing process mechanism is provided with a wiping unit 112 having a wiping member 112*a* for wiping an ejection outlet-formed surface of an ink ejection head 100. A forced suction discharging process of ink as a cleaning operation is performed when an ink ejection head is newly mounted in the recording apparatus, when recording is effected after the recording apparatus is rested for a long time, and when a user selects the cleaning operation in order to eliminate a lowering in a recording image quality. As an example of the cleaning operation, a refreshing process including a wiping operation of an ejection surface of the ink ejection head with a wiping member 112 constituted by an elastic plate such as a rubber plate may be performed after ink droplets are ejected from the ejection outlets by negative pressure generated by the refreshing pump. By this refreshing process, it is possible to keep a state in which dust or ink droplets are not deposited on the surface of the ejection outlet plate. Incidentally, the ink discharged by this cleaning operation is absorbed by a discharged ink absorbing member disposed in the main assembly of the recording apparatus and is not subjected to actual recording.

The above-described conventional ink ejection heads are accompanied with the following problem.

In recent years, in a recording apparatus such as an ink jet printer or the like, reduction of production cost without lowering recording performance is desired. As one constitution for that purpose, it is required that an amount of suction discharge of ink from the ink ejection head by the cleaning operation of the ink ejection head is suppressed as small as possible. By meeting this requirement, it is possible to reduce the production cost through elimination of a cleaning process portion in the recording apparatus, downsizing of an absorbing member for absorbing discharged ink, downsizing of the recording apparatus, and the like. Further, by reducing the amount of ink subjected to the suction discharging process, it is possible to increase the number of sheets recordable by the ink ejection head.

In the case of a constitution in which the suction refreshing unit is eliminated, the surface of the ejection outlet plate is subjected to a cleaning (wiping) operation for wiping the ejection outlet plate surface with a wiping member without performing suction from the ink ejection head. However, in the case of this constitution, as shown in FIG. 9, opening edges of a hole portion 103 provided to an ejection outlet plate 102 are formed in a sawtooth(-like) shape, so that a foreign matter 108 as shown in FIG. 10 can be caught in the sawtooth hole portion 103. That is, in some cases, the foreign matter 108 is caught in the sawtooth hole portion 103 and therefore cannot be satisfactorily removed by refreshing only by wiping. As a result, the foreign matter 108 is left while being deposited in the neighborhood of ejection outlets 106, so that surface wettability of the ejection outlet plate 102 can be changed or the ejection outlets 106 can be clogged with the foreign matter 108. For these reasons, the conventional ink ejection heads are accompanied with such a problem that an improper recording operation such as deviation of or ejection failure of ink to be ejected from the ejection outlets 106 is caused to occur.

SUMMARY OF THE INVENTION

A principal object of the present invention is to provide a liquid ejection head capable of removing a foreign matter deposited on a surface of an ejection outlet plate by a simple operation such as wiping without adversely affecting ejection outlets.

Another object of the present invention is to provide a recording apparatus using the liquid ejection head.

According to an aspect of the present invention, there is provided a liquid ejection head comprising:

a substrate comprising a liquid supply port for supplying liquid and a plurality of ejection energy generating elements, disposed along the liquid supply port, for generating energy for ejecting liquid droplets; and an ejection outlet plate comprising a plurality of ejection outlets, provided correspondingly to the plurality of ejection energy generating elements, for ejecting the liquid and comprising a plurality of liquid flow passages, provided correspondingly to the plurality of ejection outlets, for establishing communication between the ejection outlets and the liquid supply port, wherein the ejection outlet plate is provided with a hole portion formed so as to surround the liquid flow passages, the hole portion comprising a plurality of first holes which are arranged in a line and which have opening edges having a shape without an acute angle, and the hole portion further comprising a plurality of second holes having opening edges formed in a substantially sawtooth shape, as seen in a direction perpendicular to a surface of the ejection outlet plate.

According to the present invention, the hole portion of the ejection outlet plate includes the plurality of first holes arranged in a line and the second holes extended in the sawtooth shape, so that it becomes possible to satisfactorily remove the foreign matter deposited on the surface of the ejection outlet plate only by the simple operation such as wiping.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described.

Numerical values described in the following embodiments are illustrative and the present invention is not limited to these numerical values. Further, the present invention is not limited to the respective embodiments described below but may be a combination of these embodiments. The present invention is also applicable to other embodiments to be embraced in the present invention.

In the following embodiments, an ink jet recording method will be described as an applied embodiment of the present invention. However, the present invention is not limited thereto but may also be applicable to biochip preparation, electronic circuit printing, etc.

The liquid ejection head is mountable to a printer, a copying machine, a facsimile machine including a communication system, a device such as a word processor including a printer portion, and industrial recording devices compositively combined with various processing devices. For example, the liquid ejection head can also be used for biochip preparation, electronic circuit printing, ejection of medication in the form of spray, etc. For example, by using this liquid ejection head for the purpose of recording, it is possible to carry out recording on various recording media (materials) such as paper, thread, fiber, fabric, leather, metal, plastic, glass, wood, and ceramics. The term "recording" referred to in the following embodiments means not only that a significant image such as a character image or a graphical image is provided to the recording medium but also that an insignificant image such as a pattern image is provided to the recording medium.

First, a fundamental structure employed in an ink ejection head of this embodiment will be described. The ink ejection head of this embodiment is integrally constituted with an ink container in which ink as liquid is contained. As an embodiment thereof, an ink ejection head for ejecting inks of three colors of cyan, magenta and yellow will be described with reference to FIGS. 1 and 2.

Figure 2:
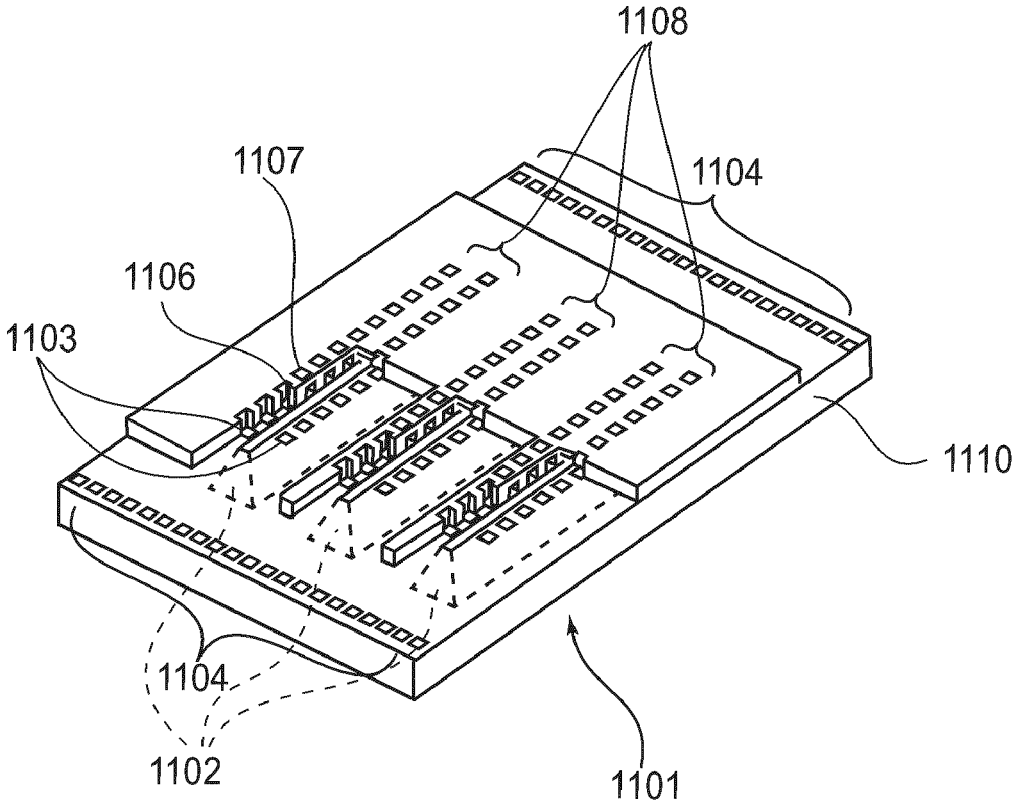
FIG. 2 is a perspective view for schematically illustrating a conventional recording element substrate.

As shown in FIG. 2, in an Si substrate 1110 provided to a recording element substrate 1101, elongated ink supply ports 1102 as liquid supply ports provided correspondingly to the respective color inks are formed. The recording element substrate 1101 includes ejection energy generating elements 1103 for generating energy for ejecting the inks and ejection outlets 1107, which are formed and arranged in arrays along both sides of the ink supply ports 1102 while sandwiching the respective ink supply ports 1102. That is, the plurality of ejection outlets 1107 are arranged along a longitudinal direction of the ink supply ports 1102 correspondingly to the respective ejection energy generating elements 1103. On the Si substrate 1110, electric wiring, an electrode portion 1104, and the like are formed and thereon, ink flow passage walls 1106 and the ejection outlets 1107 are formed by photolithography using a resin material.

Figure 1:
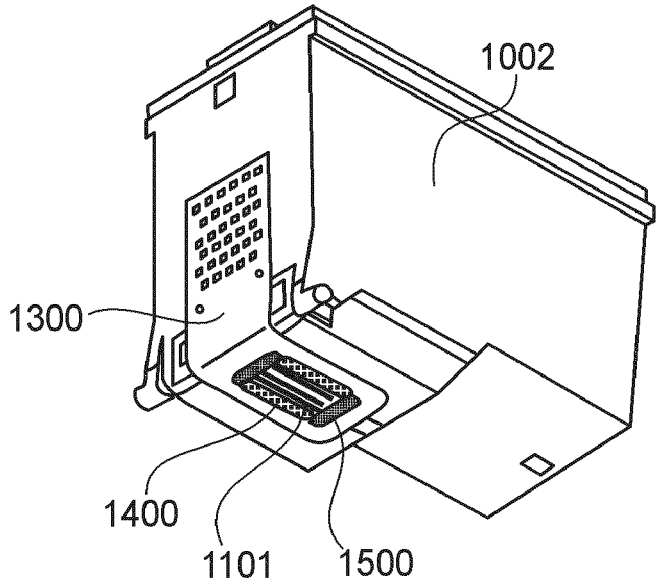
FIG. 1 is a perspective view for schematically illustrating an ink ejection head in an embodiment.

As shown in FIG. 1, an ink supply holding member 1002 is, e.g., formed by molding using a resin material. At a downstream portion of ink flow passages, ink supply ports (not shown) for supplying the respective inks of cyan, magenta and yellow to the recording element substrate 1101 are formed. The recording element substrate 1101 is adhesively fixed to the ink supply holding member 1002 with good positional accuracy so that the respective ink supply ports 1102 of the recording element substrate 1101 communicate with the respective ink supply ports of the ink supply holding member 1002. An adhesive used in this case may desirably have a low viscosity, a low curing temperature, a relatively short curing time, and ink resistance. As the adhesive, e.g., a thermosetting adhesive containing epoxy resin as a main component and may desirably be formed in a thickness of about 50 μm.

The recording element substrate 1101 is electrically connected to an electric wiring member 1300. A periphery of the recording element substrate 1101 and a portion between the recording element substrate 1101 and the ink supply holding member 1102 are sealed with a first sealing agent 1400 and a second sealing agent 1500. As a result, stagnation of ink at a side surface portion of the recording element substrate 1101 is prevented and an electrical connecting portion is protected from corrosion by the ink and external shock.

With respect to the ink ejection head of this embodiment in which the fundamental structure as described above, a detailed structure of the recording element substrate will be described.

First Embodiment

Figure 3:
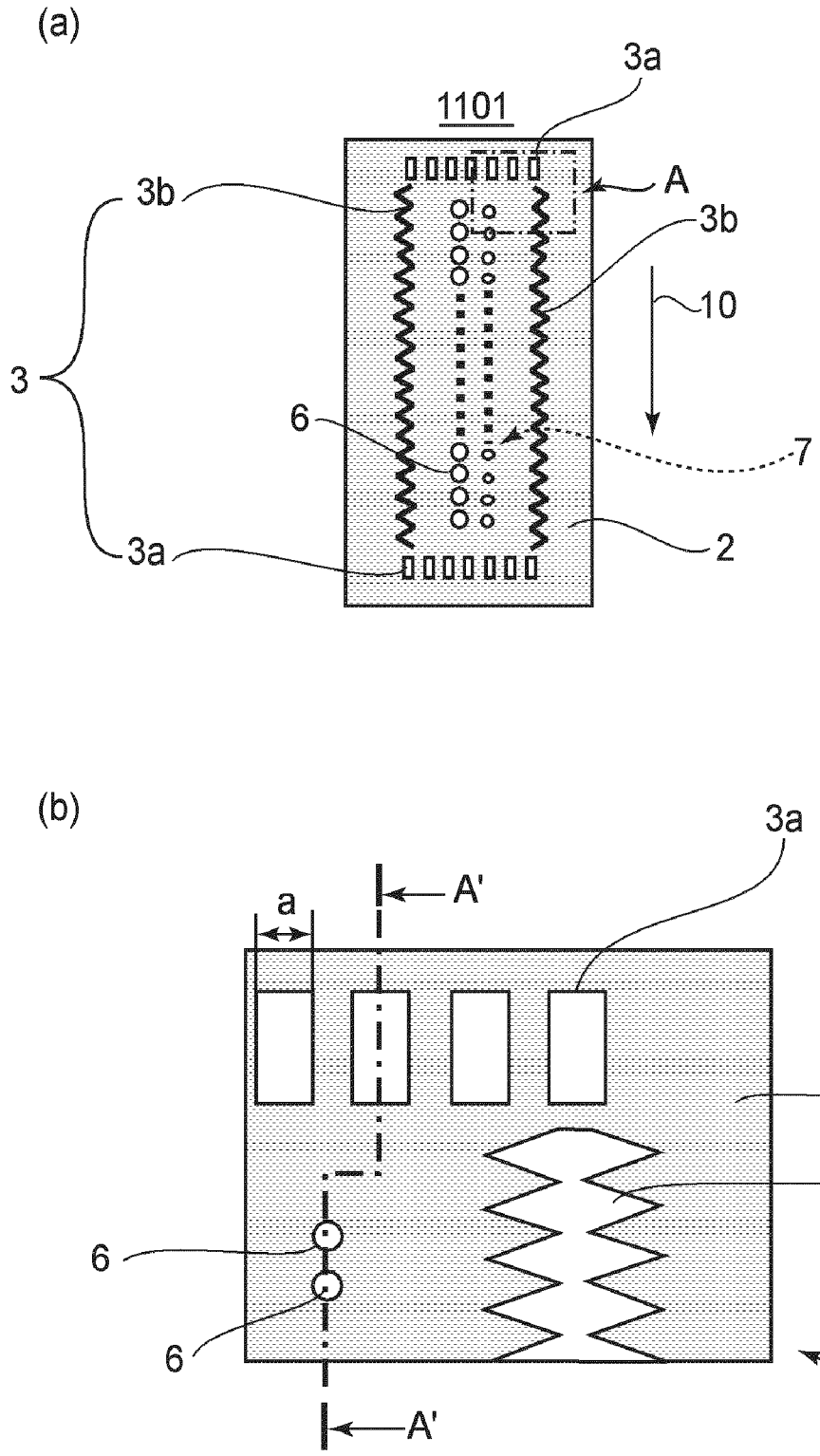
FIGS. 3(*a*) and 3(*b*) are plan views for schematically illustrating a recording element substrate in First Embodiment.

FIG. 3(*a*) illustrates a schematic plan view of the recording element substrate 1101 used in this embodiment and FIG. 3(*b*) illustrates an enlarged schematic plan view of a portion A shown in FIG. 3(*a*). Further, FIGS. 4(*a*), 4(*c*) and 4(*e*) are plan views for schematically illustrating the portion A shown in FIG. 3(*a*) in a hole portion-forming step in this embodiment and FIGS. 4(*b*), 4(*d*) and 4(*f*) are sectional views taken along A-A' line indicated in FIG. 3(*b*) correspondingly to FIGS. 4(*a*), 4(*c*) and 4(*e*), respectively. The recording element substrate 1101 includes a substrate 1 and an ejection outlet plate 2 connected to the substrate 1. The ejection outlet plate 2 is provided correspondingly to ejection outlets 6 and includes ink flow passages (liquid flow passages) 7 for establishing communication of the ejection outlets 6 and ink supply ports 9 with each other and a flow passage wall 8 for partitioning adjacent ink flow passages 7. In the ejection outlet plate 2, as shown in FIGS. 3(*a*) and 3(*b*), a hole portion 3 is formed so as to surround the ink flow passages 7. This hole portion 3 includes a plurality of first holes 3*a* arranged in an array and second holes 3*b* each having an opening edge extended in a sawtooth(-like) shape as seen in a direction perpendicular to a surface of the ejection outlet plate 2. In this embodiment, an arrangement direction of the first holes 3*a* is substantially perpendicular to an arrangement direction of the ejection outlets 6. Further, a longitudinal direction of the second holes 3*b* is substantially parallel to the arrangement direction of the ejection outlets 6.

In this embodiment, a wiping operation direction 10 which is a movement direction of a wiping member (not shown) of a refreshing process mechanism in a recording apparatus is parallel to the arrangement direction of the ejection outlets 6 as shown in FIG. 3(*a*). As in the case of the ink ejection head of this embodiment, in the case where the plurality of ejection outlet arrays provided correspondingly to a plurality of color inks is formed in parallel to each other, the wiping operation direction 10 is parallel to the arrangement direction of the ejection outlets 6. As a result, an effect such as color mixing between the respective color inks occurs less.

In the ejection outlet plate 2, only the first holes 3*a* are disposed on an extension line extended from the ejection outlets 6 with respect to the wiping operation direction 10, so that the sawtooth second holes 3*b* are not disposed on the extension line extended from the ejection outlets 6. By this constitution, catching of ink or dust in the sawtooth second holes 3*b* can be obviated during the wiping operation. Further, even when the dust is caught in the first holes 3*a*, an opening edge of the first holes 3*a* has a shape without an acute angle, so that the deposited dust can be easily removed by the wiping operation.

The substrate 1 is formed through a semiconductor manufacturing technique using a silicon semiconductor substrate or the like. The substrate 1 in this embodiment is formed in a rectangular shape and at a central portion thereof, an ink supply port 9 as a through hole extended in a longitudinal direction of the substrate 1 is formed. Parallel along both sides of the ink supply port 9 with respect to a longitudinal direction of the ink supply port 9, a plurality of energy generating elements 4 is provided. These energy generating elements 4 are, in FIG. 3(*a*), used for heating ink supplied from a back surface side of the substrate 1 through the ink supply port 9 so as to eject ink droplets from the ejection outlets 6 provided at a position opposite to the energy generating elements 4.

Figure 4:
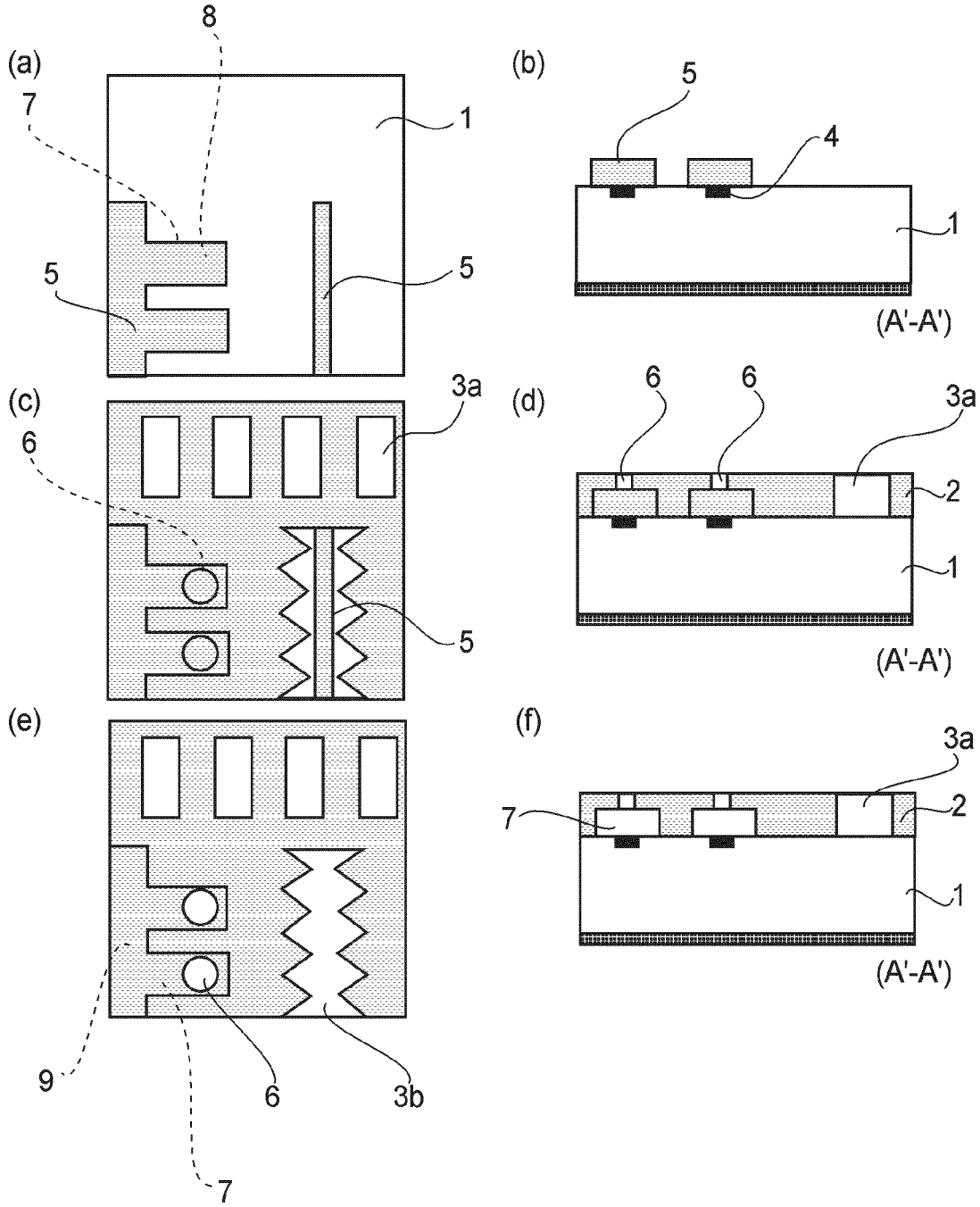
FIGS. 4(*a*) to 4(*f*) are schematic views for illustrating manufacturing steps in First Embodiment.

As shown in FIGS. 4(*a*) and 4(*b*), on the substrate 1 on which wiring is formed, an ejection outlet-forming member 5 comprising a positive resist or the like is laminated and then a portion to be formed as ink flow passages is formed by using a photolithographic step. In order to stabilize a height of a portion constituting ejection outlets 6 (in order to stabilize a position of the ejection outlets 6 with respect to a thickness direction of the substrate 1), the ejection outlet-forming member 5 is also formed at a portion at which a hole portion is to be formed in parallel to an arrangement direction of the ejection outlets 6.

Next, as shown in FIGS. 4(*c*) and 4(*d*), on the ejection outlet-forming member 5, an ejection outlet plate member constituting an ejection outlet plate is laminated and then the ejection outlets 6 and a hole portion 3 are formed by using the photolithographic step. First holes 3*a* constituting the hole portion 3 are formed to provide independent through holes, so that a bottom portion of the first holes 3*a* is constituted by a surface of the substrate 1. The first holes 3*a* in this embodiment are formed in a rectangular shape, thus having no acute angle. As a result, paper powder or the like is less liable to deposit in the first holes 3*a*. Further, even when the paper powder deposits in the first holes 3*a*, the paper powder is liable to be removed. Second holes 3*b* constituting the hole portion 3 are each formed in a shape such that an opening edge thereof is extended in a sawtooth shape. The plurality of first holes 3*a* is formed at an arrangement interval identical to that of the respective ejection outlets 6. Further, the first holes 3*a* are, as shown in FIG. 4(*b*), formed with respect to a direction perpendicular to an operation direction of a wiping member, i.e., formed so that each first hole 3*a* has a width a, with respect to the direction perpendicular to the arrangement direction of the ejection outlets 6, of 20 μm. The ejection outlet plate member contacts the ink or the like, so that the ejection outlet plate member may be a resin material having ink resistance, preferably a negative photocurable epoxy resin material.

Therefore, the ink supply port 9 is formed by using a processing method such as anisotropic etching and the ejection outlet-forming member 5 is removed by using a solvent or the like, so that the recording element substrate 1101 for the ink ejection head is prepared as shown in FIGS. 4(*e*) and 4(*f*). Incidentally, in order to improve adhesiveness between the ejection outlet plate and the substrate, an ejection outlet plate adhesiveness-improving layer may also be formed, on the substrate, of a resin material having ink resistance before the above-described ejection outlet-forming member is formed.

The thus prepared recording element substrate 1101 is electrically connected to the electric wiring member 1300 and then is connected to a container forming member 1002 by using an adhesive and a sealing agent to prepare the ink ejection head of this embodiment.

By using the thus prepared ink ejection head, a paper powder test for confirming whether or not paper powder (powdery paper) deposited on the surface of the ejection outlet plate can be removed by only a wiping operation of a refreshing process mechanism provided to the recording apparatus was conducted. At the first hole 3*a* portion, it was possible to remove the paper powder by only the wiping operation and no change was observed, even when recording was made before and after the paper powder test, to achieve a good result. At the second hole 3*b* portion, the paper powder was deposited but the ejection outlets 6 are not formed on a downstream side of the second holes 3*b* with respect to the wiping operation direction, so that a recording state was not adversely affected.

The recording element substrate 1101 portion including the substrate 1 was subjected to a temperature cycle test in a state the portion is provided with a rubber cap. Specifically, the temperature cycle test was conducted in the following manner. First, the recording element substrate 1101 portion was kept at 60° C. for 2 hours and was decreased in temperature down to −30° C. in 2 hours at a constant temperature-lowering rate. Thereafter, the portion was increased in temperature up to 60° C. in 2 hours at a constant temperature-rising rate after being left at −30° C. for 2 hours. The above described steps were taken as one cycle and 10 cycles were carried out. As a result, at the hole portion 3 of the ink ejection head of this embodiment, no separation at a frame portion between the ejection outlet plate and the substrate occurred or a degree of the separation was slight even when the separation occurred, so that the separation was capable of being suppressed at a level of substantially no problem. Even when recording was made before and after the temperature cycle test, no change was observed to obtain a good result.

In this embodiment, the width of the first hole 3*a* formed with respect to the direction perpendicular to the wiping operation direction 10 was 20 μm. A foreign matter includes the paper powder, silicon pieces, and the like but most of the foreign matter is the paper powder. In this embodiment, the paper powder had a width (size) of about 20 μm even with respect to the smallest paper powder. For that reason, by providing the first hole 3*a* with a width of 20 μm or less, the foreign matter can be removed by the wiping operation with no catching of the foreign matter in the first hole 3*a* portion. In this embodiment, the width a of the first hole 3*a* is 20 μm but even when the dimension of the above-described width a is less than 20 μm, there is no problem if a first hole 3*a* having such a width is formable in consideration of constraint of the photolithographic step.

As described above, in the ink ejection head of this embodiment, the hole portion 3 formed in the ejection outlet plate 2 so as to surround the ink flow passages 7 includes the plurality of first holes 3*a* arranged in arrays and the second holes 3*b* having the ejection outlet extended in the sawtooth shape as seen in the direction perpendicular to the surface of the ejection outlet plate 2. As a result, it becomes possible to remove the foreign matter deposited on the surface of the ejection outlet plate 2 with no adverse affect on the ejection outlets 6 by only a simple operation such as wiping.

Further, according to this embodiment, the ejection outlet plate 2 is provided with the hole portion 3, so that an occurrence of separation between the ejection outlet plate 2 and the substrate 1 can be prevented even in the case where the ejection outlet 6 portion is used for a long time. Further, even when the separation occurs, a degree of the separation is slight, thus being suppressed at a level of substantially no problem.

Further, in the recording apparatus including the ink ejection head of this embodiment, even in a constitution in which a suction refreshing unit including a refreshing pump is eliminated from the refreshing process mechanism, it is possible to satisfactorily remove the foreign matter deposited on the surface of the ejection outlet plate 2 by only the simple operation such as wiping. Therefore, according to the recording apparatus of this embodiment, it is not necessary to provide a function for performing suction refreshing, so that it is possible to realize reduction of production cost of the recording apparatus, downsizing of the recording apparatus, and improvement in utilization factor of the ink.

Second Embodiment

Figure 5:
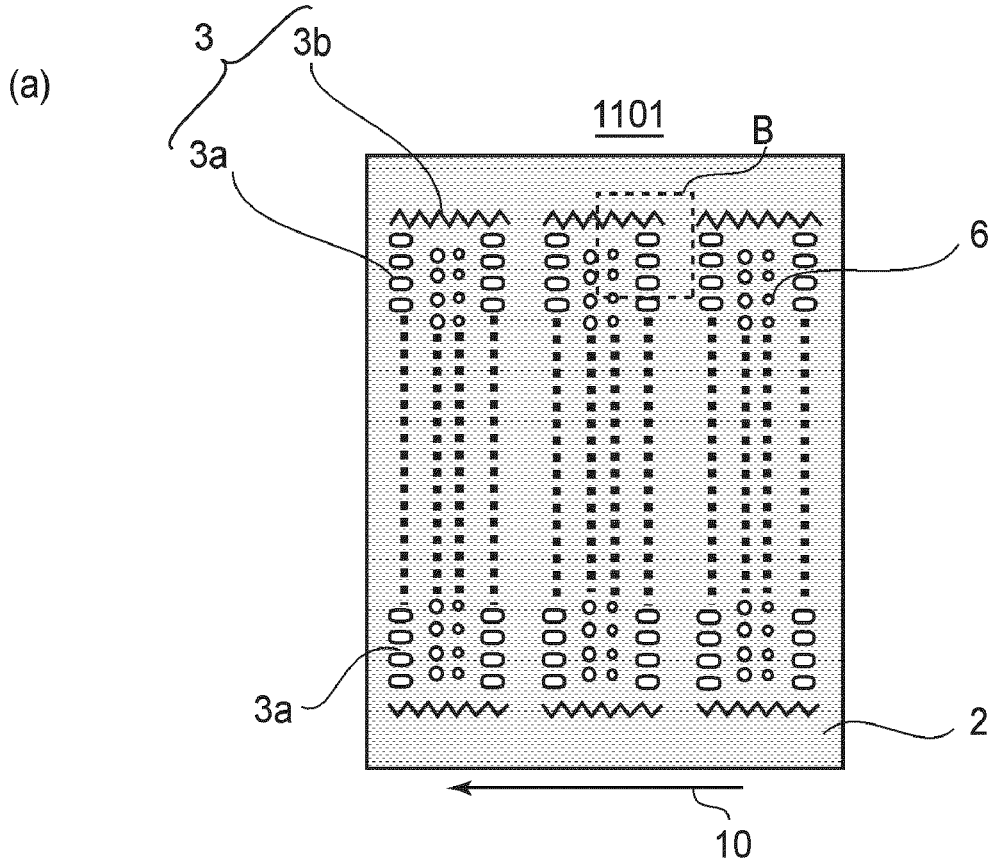
FIGS. 5(*a*) and 5(*b*) are plan views for schematically illustrating a recording element substrate in Second Embodiment.
Figure 5:
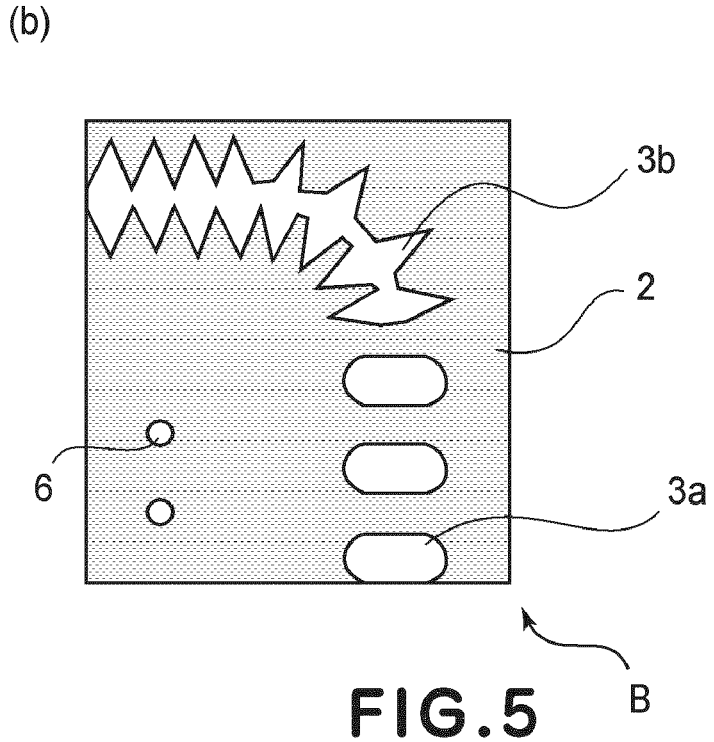

FIG. 5(*a*) illustrates a schematic plan view of the recording element substrate 1101 used in this embodiment and FIG. 5(*b*) illustrates an enlarged schematic plan view of a portion B shown in FIG. 5(*a*). Further, FIGS. 6(*a*), 6(*b*) and 6(*c*) are plan views for schematically illustrating a hole portion-forming step for the recording element substrate 1101 in this embodiment.

In the ejection outlet plate 2, as shown in FIGS. 5(*a*) and 5(*b*), a hole portion 3 is formed so as to surround the ink flow passages 7. This hole portion 3 includes a plurality of first holes 3*a* arranged in an array and second holes 3*b* each having an opening edge extended in a sawtooth(-like) shape as seen in a direction parallel to a surface of the ejection outlet plate 2. In this embodiment, an arrangement direction of the first holes 3*a* is substantially parallel to an arrangement direction of the ejection outlets 6. Further, a longitudinal direction of the second holes 3*b* is substantially perpendicular to the arrangement direction of the ejection outlets 6.

In this embodiment, a wiping operation direction 10 in a recording apparatus is perpendicular to the arrangement direction of the ejection outlets 6 as shown in FIG. 5(*a*). Generally, the ink ejection head is subjected to scanning with respect to a direction perpendicular to the arrangement direction of the ejection outlets 6 when a recording operation is performed. Therefore, in the case where the wiping operation direction 10 is parallel to the arrangement direction of the ejection outlets 6 and the wiping is performed along the wiping operation direction 10 as in First Embodiment, the recording apparatus is required to be provided with a driving mechanism as driving means for performing a moving operation of the wiping member.

However, as in this embodiment, in the case where the wiping operation direction 10 is perpendicular to the arrangement direction of the ejection outlets 6, the wiping member may also be disposed at an intermediary portion of a path for a moving operation of the ink ejection head in the recording apparatus. According to this constitution, the wiping can be performed during the recording operation of the ink ejection head. In the case of this constitution, a driving portion for moving the ink ejection head functions as the driving means for moving the wiping member along the surface at which the ejection outlets are formed. For this reason, the recording apparatus is not required to be provided with the driving mechanism for performing the moving operation of the wiping member, so that downsizing of the recording apparatus and cost reduction of the recording apparatus can be realized.

Figure 6:
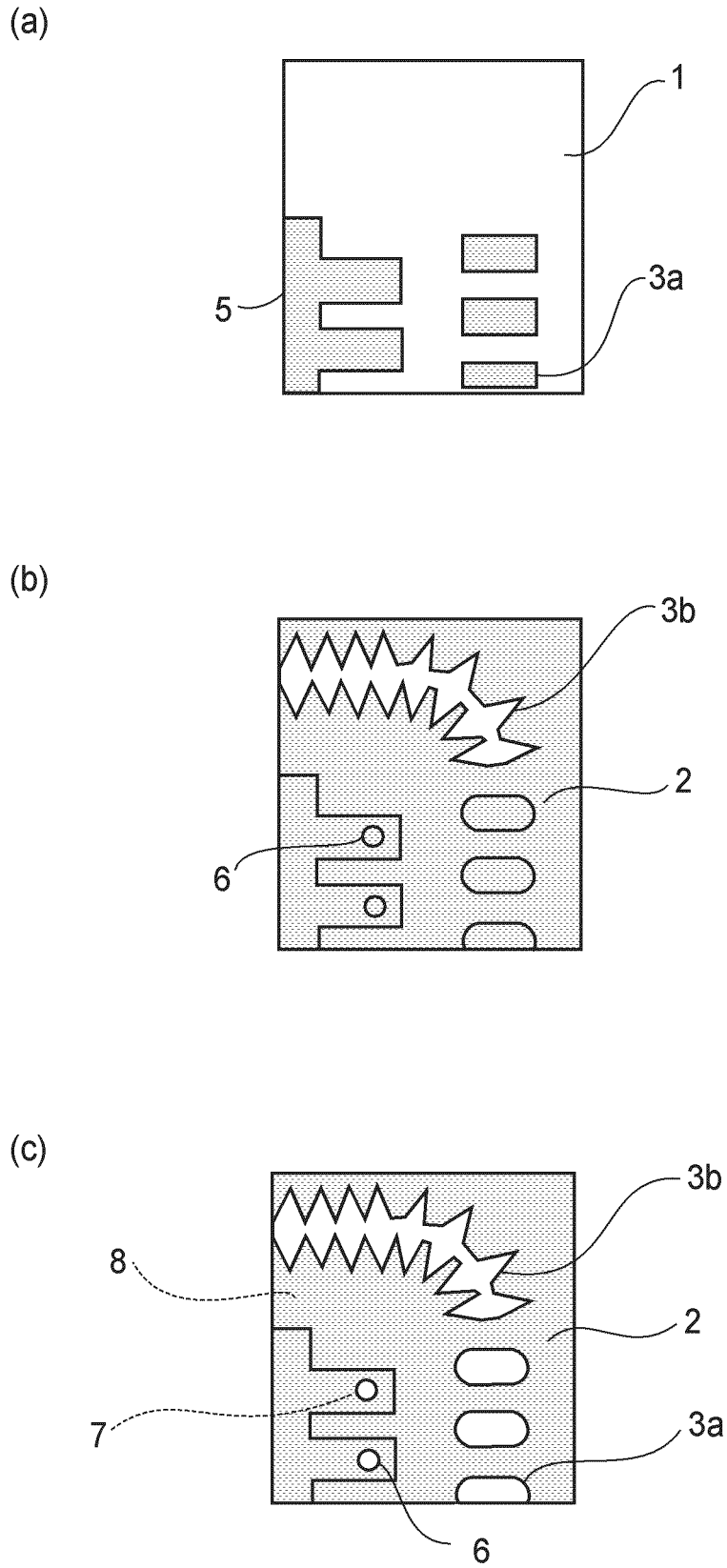
FIGS. 6(*a*), 6(*b*) and 6(*c*) are plan views for schematically illustrating manufacturing steps in Second Embodiment.

In this embodiment, an opening shape constituted by an opening edge of the first holes 3*a* is such a shape that a curve and a straight line are connected. Further, the ejection outlet-forming member 5 is, as shown in FIG. 6(*b*), formed in a shape correspondingly to the first holes 3*a*. In this embodiment, as shown in FIGS. 6(*a*) and 6(*c*), the recording element substrate 1101 for the ink ejection head and the ink ejection head were manufactured in the same manner as in First Embodiment except for the above-described shape features.

By using the thus manufactured ink ejection head, the above-described paper powder test and temperature cycle test were conducted. In either test, residual paper powder at the first hole portion or separation of the first hole portion was not observed. Further, even when recording state before and after each of the tests were compared, no change was observed to obtain a good result.

According to this embodiment, it was possible to remove the foreign matter such as the paper powder with a less number of wiping operations them the case of First Embodiment by constituting the opening edge of the first hole 3*a* in combination of the curve with the straight line. In the case where the opening edge of the first hole 3*a* is provided with a corner, a possibility of an occurrence of catching of the foreign matter in the corner is high. Particularly, in the case of the ejection outlet is provided with a corner having an acute angle, when the wiping operation is performed in a state in which the foreign matter is caught in the corner, the foreign matter enters a deep portion of the corner and therefore there is a possibility that the foreign matter is rather less liable to be removed. Therefore, in the case of forming a corner in an opening edge of the hole, removal of the foreign matter is facilitated by the wiping operation by providing the corner with an angle of 90 degrees or more, preferably an obtuse angle. Further, in the case where the opening edge of the hole is constituted by a curve, an occasion of the catching of the foreign matter in the opening edge of the hole is considerably suppressed. Therefore, the foreign matter caught in the hole is reduced in amount, so that the curved opening edge is preferable in terms of satisfactory removal of the foreign matter by a further less number of wiping operations.

In this embodiment, the plurality of first holes 3*a* disposed on both sides of the ejection outlets 6 arranged in two adjacent arrays is formed in the same shape, but may also be formed in different shapes depending on an arrangement of the ejection outlets, a change in type of the foreign matter, and the like.

Further, with respect to the sawtooth shape of the second hole 3*b*, an angle of the sawtooth is effective in preventing separation of the ejection outlet plate from the substrate even in the case where the angle is an acute angle and the case where the angle is an obtuse angle. In a preferred embodiment, the sawtooth shape having the acute angle such that a force exerted on the opening edge of the hole portion with respect to a normal direction of the opening edge is weak is a shape causing less separation.

Third Embodiment

Figure 7:
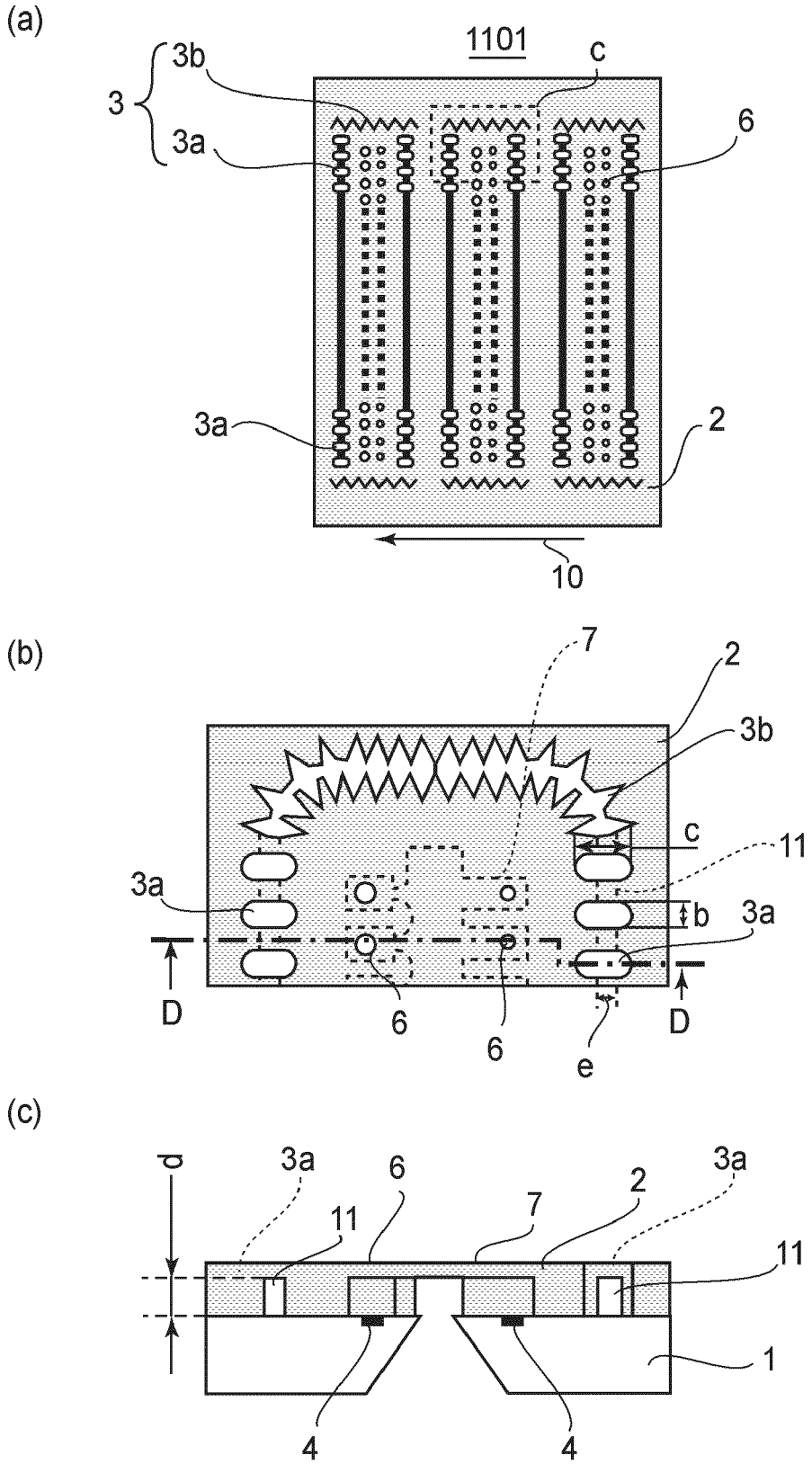
FIGS. 7(*a*), 7(*b*) and 7(*c*) are schematic views for illustrating a recording element substrate in Third Embodiment.
Figure 8:
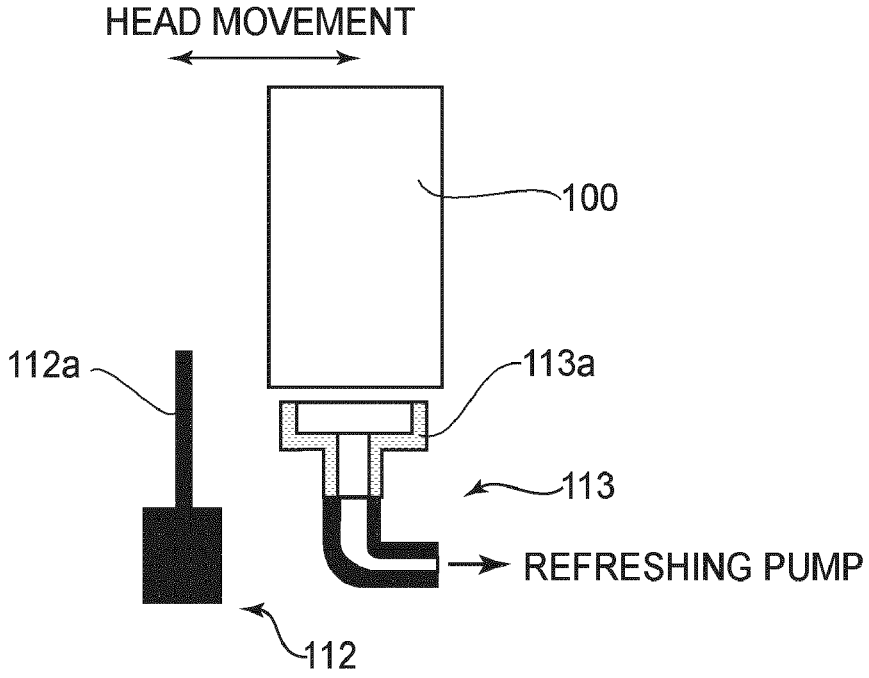
FIG. 8 is a schematic view for illustrating a refreshing (system) device provided to a conventional recording apparatus.
Figure 9:
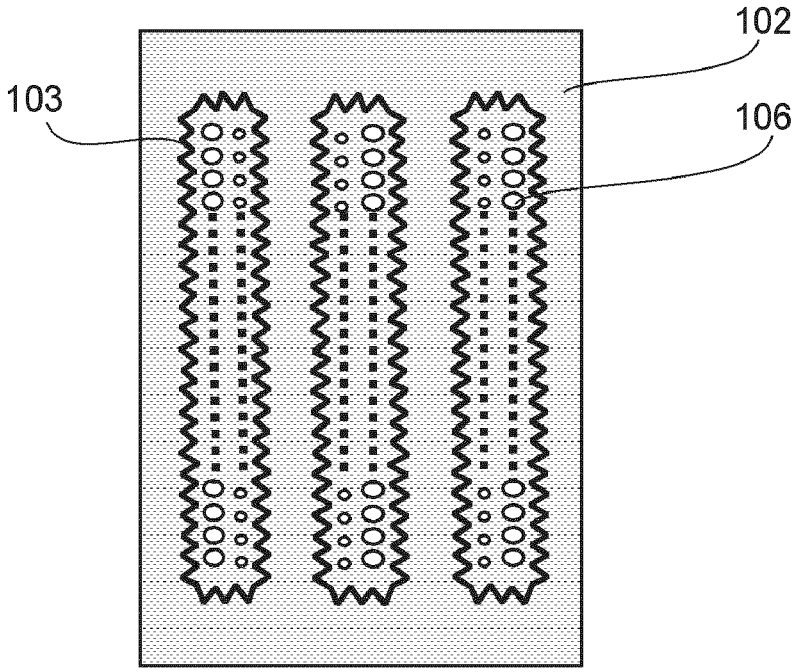
FIG. 9 is a plan view for schematically illustrating an ejection outlet-formed surface of a conventional recording element substrate.
Figure 10:
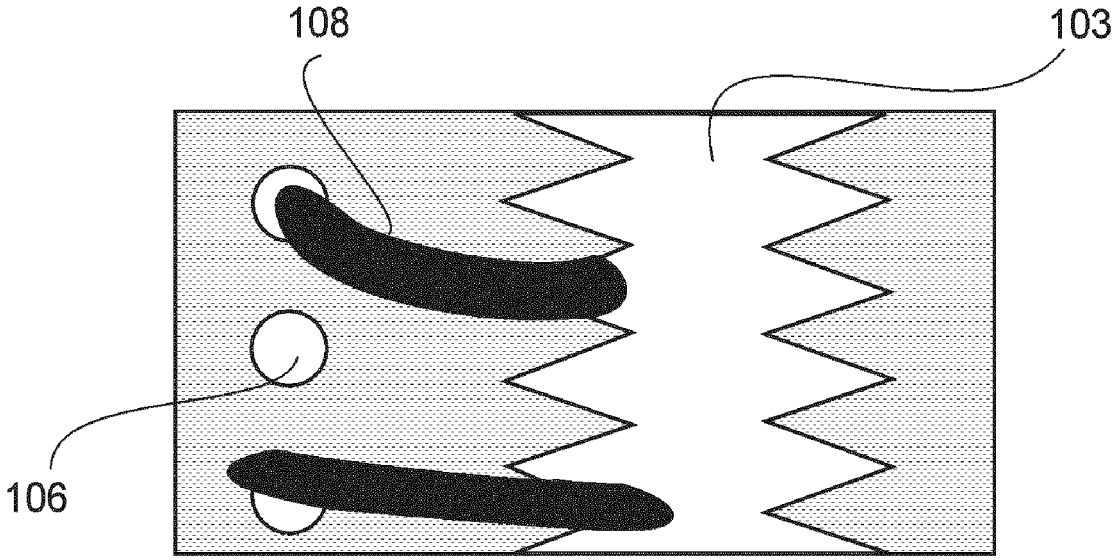
FIG. 10 is a plan view for schematically illustrating a foreign matter deposition state in a conventional hole portion.

FIG. 7(*a*) illustrates a schematic plan view of the recording element substrate 1101 used in this embodiment and FIG. 7(*b*) illustrates an enlarged schematic plan view of a portion C shown in FIG. 7(*a*). Further, FIG. 7(*c*) is a schematic sectional view taken along D-D line indicated in FIG. 7(*b*).

In this embodiment, a width (length) b of a first hole 3*a* with respect to a direction parallel to an arrangement direction of ejection outlets 6 was 0.02 mm and a width (length) c of the first hole 3*a* with respect to a direction perpendicular to the arrangement direction of ejection outlets 6 was 0.045 mm. Further, at a lower portion of an ejection outlet-forming member 5, communicating passages 11 each disposed between adjacent first holes 3*a* and establishing communication of these first holes 3*a* with each other are provided. In this embodiment, as shown in FIGS. 7(*b*) and 7(*c*), the communicating passages 11 were formed in a height of 0.014 mm with respect to a thickness of the substrate 1 and a width (length) e of 0.02 mm with respect to a direction perpendicular to the arrangement direction of ejection outlets 6. The communicating passages 11 were formed in a photolithographic step of the ejection outlet-forming member 5.

Except for the communicating passages, by using the method described in First Embodiment, the recording element substrate 1101 and an ink ejection head were prepared. In this embodiment, wiping is performed with respect to a wiping operation direction 10 substantially perpendicular to the arrangement direction of the ejection outlets 6.

By using the thus manufactured ink ejection head, the above-described paper powder test and temperature cycle test were conducted. In either test, residual paper powder at the first hole 3*a* portion or separation of the hole portion was not observed. Further, even when recording state before and after each of the tests were compared, no change was observed to obtain a good result.

A manufacturing process of the ink ejection head includes a step of blowing air on a surface of an ejection outlet plate in order to remove water droplets remaining in the hole portion 3 and ink droplets which have not been completely washed.

At the lower portion of the ejection outlet plate, the communicating passage 11 is formed between adjacent first holes 3*a* to establish communication of the first holes 3*a* with each other, so that the ink remaining in a first hole 3*a* of the hole portion 3 is moved to an adjacent first hole 3*a* by the air blowing. For this reason, a blowing effect can be sufficiently achieved, so that it becomes possible to remove the water droplets and the ink droplets which have not been completely washed. Further, the air blowing is performed with respect to a direction of an array of the first holes 3*a*, so that it is possible to more efficiently remove the water droplets stagnated in the communicating passages 11 and the ink droplets which have not been completely washed. Further, in the case where second holes 3*b* are provided with a shape like the above-described communicating passages 11, the air is less liable to enter the communicating passages 11, so that there is a possibility that the water droplets or the like remain in the communicating passages 11. For that reason, as in this embodiment, the second holes 3*b* may preferably have a continuous shape also from the view point of water droplet removal. As a result, a lowering in quality such that the residual water droplets or the ink droplets which have not been completely washed are vaporized to remain as a viscosity-increased matter or a fixed matter during transport to a user after manufacturing.

In this embodiment, an inner wall surface of the communicating passage is formed in a shape of a substantially straight line parallel to the arrangement direction of the first holes but may also be formed in a sawtooth(-like) shape depending on a degree of elongation of the substrate, an arrangement of the ejection outlets, a shape the first holes, a change in dimension of the first holes, and the like. An edge of the hole contacting the substrate is formed in a sawtooth shape, so that a force exerted in a normal direction to the hole edge is weakened. For this reason, the ejection outlet plate is less liable to separate from the substrate. Further, in this embodiment, such a constitution that the plurality of ejection outlets is arranged in the straight line-like shape is employed but it is also possible to employ a constitution in which the plurality of ejection outlets is arranged with alternately deviated positions with respect to a direction perpendicular to their arrangement direction, i.e., in a so-called staggered fashion.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 012885/2008 filed Jan. 23, 2008, and 002616/2009 filed Jan. 8, 2009, which are hereby incorporated by reference.

What is claimed is:

1. A liquid ejection head comprising:

a substrate comprising a liquid supply port for supplying liquid and a plurality of ejection energy generating elements, disposed along the liquid supply port, for generating energy for ejecting liquid droplets; and an ejection outlet plate comprising a plurality of ejection outlets, provided correspondingly to the plurality of ejection energy generating elements, for ejecting the liquid and comprising a plurality of liquid flow passages, provided correspondingly to the plurality of ejection outlets, for establishing communication between the ejection outlets and the liquid supply port, wherein said ejection outlet plate is provided with a hole portion formed so as to surround the liquid flow passages, said hole portion comprising a plurality of first holes which are arranged in a line and which have opening edges having a shape without an acute angle, and said hole portion further comprising a plurality of second holes having opening edges formed in a substantially sawtooth shape, with respect to a direction perpendicular to a surface of said ejection outlet plate.

2. A head according to claim 1, wherein the first holes have an arrangement direction substantially perpendicular to an arrangement direction of the ejection outlets and the second holes have a longitudinal direction substantially parallel to the arrangement direction of the ejection outlets.

3. A head according to claim 1, wherein the first holes have an arrangement direction substantially parallel to an arrangement direction of the ejection outlets and the second holes have a longitudinal direction substantially perpendicular to the arrangement direction of the ejection outlets.

4. A head according to claim 1, wherein the opening edges of each of the first holes are formed by a combination of a curve and a straight line.

5. A head according to claim 1, wherein the first holes are formed at an arrangement interval identical to that of the ejection outlets.

6. A head according to claim 1, further comprising a communication passage for establishing communication between adjacent first holes.

7. A head according to claim 1, wherein the first holes are provided so as to penetrate through said ejection outlet plate and a bottom portion of each of the first holes is constituted by a surface of said substrate.

8. A recording apparatus comprising:

a liquid ejection head comprising a substrate comprising a liquid supply port for supplying liquid and a plurality of ejection energy generating elements, disposed along the liquid supply port, for generating energy for ejecting liquid droplets; and an ejection outlet plate comprising a plurality of ejection outlets, provided correspondingly to the plurality of ejection energy generating elements, for ejecting the liquid and comprising a plurality of liquid flow passages, provided correspondingly to the plurality of ejection outlets, for establishing communication between the ejection outlets and the liquid supply port, wherein the ejection outlet plate is provided with a hole portion formed so as to surround the liquid flow passages, the hole portion comprising a plurality of first holes which are arranged in a line and which have opening edges having a shape without an acute angle, and the hole portion further comprising a plurality of second holes having opening edges extended in a substantially sawtooth shape, with respect a direction perpendicular to a surface of the ejection outlet plate;

a wiping member for wiping a surface of said liquid ejection head at which the ejection outlets are formed; and driving means for moving said wiping member along the surface, wherein said wiping member is formed so that a movement direction thereof by said driving means is substantially perpendicular to an arrangement direction of the first holes.

9. An apparatus according to claim 8, wherein only the first holes are disposed on an extension line extended from the ejection outlets with respect to the movement direction of said wiping member.

* * * * *